US008385763B2

(12) United States Patent
Tsukioka

(10) Patent No.: US 8,385,763 B2
(45) Date of Patent: Feb. 26, 2013

(54) HEATING FIXER AND IMAGE FORMING APPARATUS HAVING POSITION DETECTORS AND BLOCKING BLADES

(75) Inventor: Yasutada Tsukioka, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 301 days.

(21) Appl. No.: 12/854,444

(22) Filed: Aug. 11, 2010

(65) Prior Publication Data

US 2011/0058839 A1 Mar. 10, 2011

(30) Foreign Application Priority Data

Sep. 4, 2009 (JP) ..... 2009-205034

(51) Int. Cl.
*G03G 15/20* (2006.01)

(52) U.S. Cl. ..... 399/67; 399/122; 399/328

(58) Field of Classification Search ..... 399/67, 399/122, 328
See application file for complete search history.

(56) References Cited

U.S. PATENT DOCUMENTS

| | | | | |
|---|---|---|---|---|
| 4,232,959 | A * | 11/1980 | Ateya et al. | 399/67 |
| 6,687,468 | B2 * | 2/2004 | Holubek et al. | 399/67 |
| 2007/0014585 | A1 * | 1/2007 | Nagasu et al. | 399/67 |
| 2010/0008683 | A1 * | 1/2010 | Yoshikawa | 399/69 |
| 2012/0093531 | A1 * | 4/2012 | Yuasa et al. | 399/67 |

FOREIGN PATENT DOCUMENTS

| | | |
|---|---|---|
| JP | 9-171320 | 6/1997 |
| JP | 10-293499 | 11/1998 |
| JP | 11-305588 | 11/1999 |
| JP | 2001-22219 | 1/2001 |
| JP | 2001-75416 | 3/2001 |
| JP | 2001-282041 | 10/2001 |
| JP | 2002-23546 | 1/2002 |
| JP | 2002-40863 | 2/2002 |
| JP | 2002-202684 | 7/2002 |
| JP | 2003-15461 | 1/2003 |
| JP | 3541842 | 4/2004 |
| JP | 2005-10593 | 1/2005 |
| JP | 2007-293037 | 11/2007 |

* cited by examiner

*Primary Examiner* — Ryan Walsh
(74) *Attorney, Agent, or Firm* — Oblon, Spivak, McClelland, Maier & Neustadt, L.L.P.

(57) ABSTRACT

A heating fixer, including a fixing member heating and melting a toner image; a pressure member contacting the fixing member upon application of pressure to form a nip; a variable device varying the pressure of the pressure member to the fixing member with rotation of a cam to vary a width of the nip into at least three steps; a drive motor driving the cam; and at least two position detectors detecting a rotational position of the cam, wherein each of the position detectors is formed of a fixed transmission sensor and a blocking filler coaxially rotating with the cam in a body, the blocking filler includes a blocking blade capable of blocking light received by the transmission sensor, the plural blocking fillers include blocking blades so as to have phases different from each other among the blocking fillers.

7 Claims, 8 Drawing Sheets

| PRESENT POSITION | DESIGNATED POSITION | MOTOR ROTATIONAL DIRECTION | NUMBER OF COUNT |
|---|---|---|---|
| H.P. | POSITION 1 | CCW | 1 |
| H.P. | POSITION 2 | CCW | 2 |
| H.P. | POSITION 3 | CCW | 3 |
| POSITION 1 | POSITION 2 | CCW | 1 |
| POSITION 1 | POSITION 3 | CCW | 2 |
| POSITION 2 | POSITION 3 | CCW | 1 |
| POSITION 3 | POSITION 2 | CW | 1 |
| POSITION 3 | POSITION 1 | CW | 2 |
| POSITION 3 | H.P. | CW | 3 |
| POSITION 2 | POSITION 1 | CW | 1 |
| POSITION 2 | H.P. | CW | 2 |
| POSITION 1 | H.P. | CW | 1 |

HEATING FIXER AND IMAGE FORMING APPARATUS HAVING POSITION DETECTORS AND BLOCKING BLADES

BACKGROUND OF THE INVENTION

1. Field of the Invention

The present invention relates to a heating fixer and an image forming apparatus, and more particularly to a heating fixer melting a toner adhering to a recording medium upon application of heat to fix the toner thereon and to an image forming apparatus including the fixer, such as a copier, a printer, and a facsimile machine.

2. Discussion of the Background

Image forming apparatuses such as electrophotographic copiers, printers and facsimile machines use heating fixers fixing toner images transferred onto recording media such as paper upon application of pressure and heat to melt the toner images. A sheet of paper on which is formed an unfixed toner image is passed through a nip formed by a fixing roller heated by a heater and a pressure roller to fix the toner image on the paper.

It is essential for such heating fixers to apply an optimum amount of heat, which varies depending on the type of paper used and its thickness. For example, there is known a method of changing a temperature of the fixing roller to change an amount of heat applied to a paper. However, it takes time to control the temperature of the fixing roller, which occasionally causes a downtime. Other methods involve changing a pressure applied by the pressure roller to the fixing roller and a width of the nip to control an amount of heat when a sheet of paper passes through the nip.

The heating fixer having a changeable nip width has, e.g., a configuration like that shown in FIG. 1A, in which a biasing member 108 as a pressurizer contacts a pressure roller (pressure member) 105 with an unillustrated fixing roller (fixing member) upon application of pressure, and the pressurizer controls the pressure to the pressure roller 105 by rotation of a cam 101, indicated by a two-headed arrow.

As FIG. 1B shows, a blocking filler 102 rotatable in the direction of an arrow with the cam 101 blocks light received by a transmission sensor 103 to control the cam 101. For example, after the blocking filler 102 blocks light received by a transmission sensor 103, the blocking filler 102 stops at a home position (hereinafter referred to as "H.P.") shown on the right after a specific number of rotations. Then, the blocking filler 102 rotates at a specific angle according to the type of paper and its thickness to a pressure position shown on the left.

However, every time the type of paper or its thickness is changed, the blocking filler 102 needs to return to the H.P., which takes time.

It is possible to shorten the time if the nip width can be adjusted by setting a rotational direction and a minimum rotational amount of the cam needed while keeping the nip width information at the time without returning the blocking filler to the H.P. when the type of paper or its thickness is changed.

However, when such a control is repeated, it is possible that the movement of the blocking filler to the H.P. is gradually shifted due to gear backlash from a gear driving the cam.

For these reasons, a need exists for a heating fixer capable of stopping the cam at a desired position even when repeating operation without transferring the cam to the H.P., and quickly and precisely optimizing a nip width according to the type of paper used and its thickness.

SUMMARY OF THE INVENTION

Accordingly, an object of the present invention is to provide a heating fixer capable of stopping the cam at a desired position even when repeating operation without transferring the cam to the H. P., and quickly and precisely optimizing a nip width according to papers and their thickness.

Another object of the present invention is to provide an image forming apparatus using the heating fixer.

These objects and other objects of the present invention, either individually or collectively, have been satisfied by the discovery of a heating fixer, comprising:

a fixing member configured to heat and melt a toner image;

a pressure member configured to contact the fixing member upon application of pressure to form a nip;

a pressure member controller comprising a cam, configured to vary the pressure of the pressure member against the fixing member with rotation of the cam to set the nip to at least three different widths;

a drive motor configured to drive the cam; and at least two position detectors configured to detect a rotational position of the cam, each of the position detectors formed of a fixed transmission sensor and a blocking filler coaxially rotating with the cam in a body, the blocking filler comprising a blocking blade capable of blocking light received by the transmission sensor, the blocking blades of the blocking fillers having phases different from one another, the blocking blades cutting across the light received by the transmission sensor to switch on and off signals of the transmission sensor as the blocking filler rotates, the rotational position of the cam controlled by switching the signals of the transmission sensor.

transmission sensor and a blocking filler coaxially rotating with the cam in a body, wherein the blocking filler comprises a blocking blade capable of blocking light received by the transmission sensor, wherein the plural blocking fillers comprise blocking blades so as to have phases different from each other among the blocking fillers, and wherein the rotational position of the cam is controlled by the number of switching on and off of signals of the transmission sensor when the blocking filler rotates such that the blocking blade cuts across the light received by the transmission sensor.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIG. 1A is a schematic view illustrating a configuration of the heating fixer having a variable nip width, and FIG. 1B is a schematic view for explaining positions of a blocking filler and a transmission sensor;

DETAILED DESCRIPTION OF THE INVENTION

The present invention provides a heating fixer capable of stopping the cam at a desired position even when repeating operation without transferring the cam to the H.P., and quickly and precisely optimizing a nip width according to papers and their thickness. Particularly, the present invention relates to a heating fixer, comprising:

a fixing member configured to heat and melt a toner image;

a pressure member configured to contact the fixing member upon application of pressure to form a nip;

a pressure member controller comprising a cam, configured to vary the pressure of the pressure member against the fixing member with rotation of the cam to set the nip to at least three different widths;

a drive motor configured to drive the cam; and at least two position detectors configured to detect a rotational position of the cam, each of the position detectors formed of a fixed transmission sensor and a blocking filler coaxially rotating with the cam in a body, the blocking filler comprising a blocking blade capable of blocking light received by the transmission sensor, the blocking blades of the blocking fillers having phases different from one another, the blocking blades cutting across the light received by the transmission sensor to switch on and off signals of the transmission sensor as the blocking filler rotates, the rotational position of the cam controlled by switching the signals of the transmission sensor.

Figure 1A:
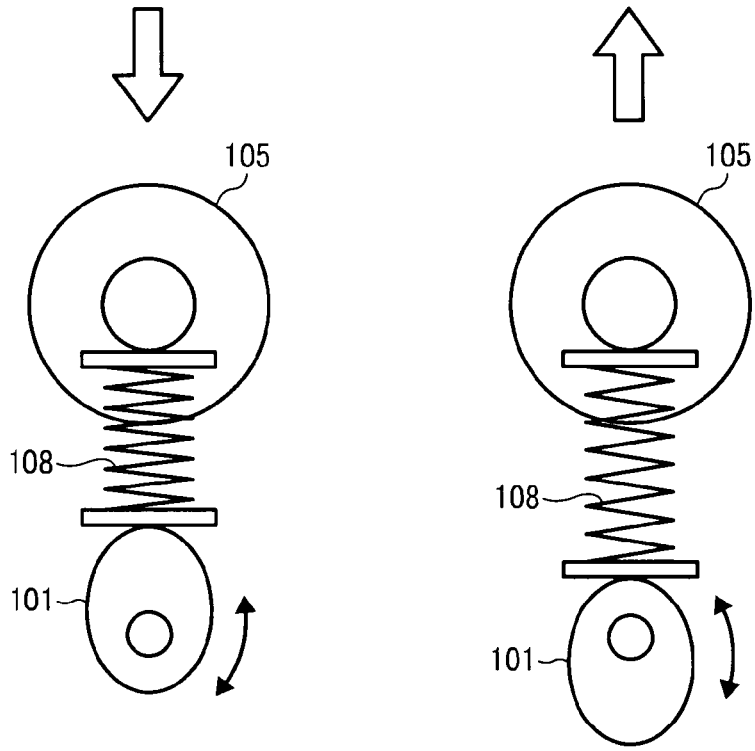
FIGS. 1A and 1B are a schematic view illustrating an example of conventional heating fixers.
Figure 1B:
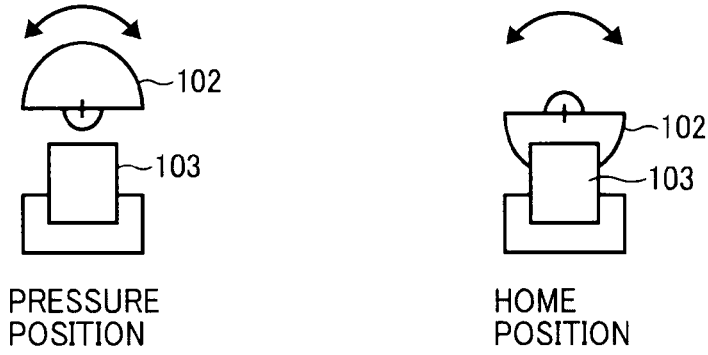
Figure 2:
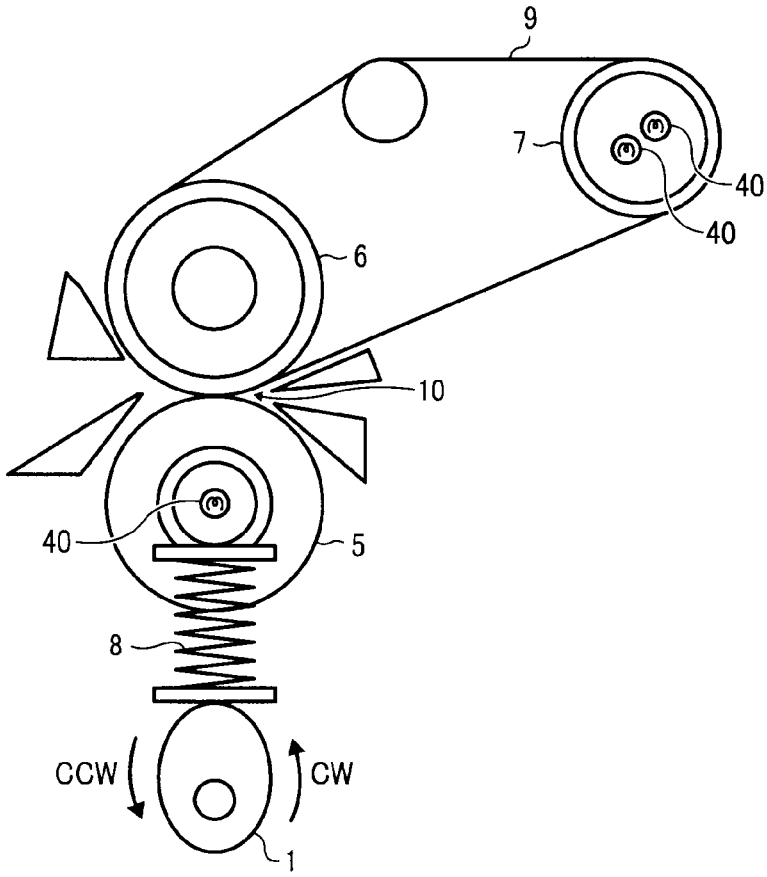
FIG. 2 is a schematic configuration view illustrating an embodiment of the heating fixer of the present invention.
Figure 3:
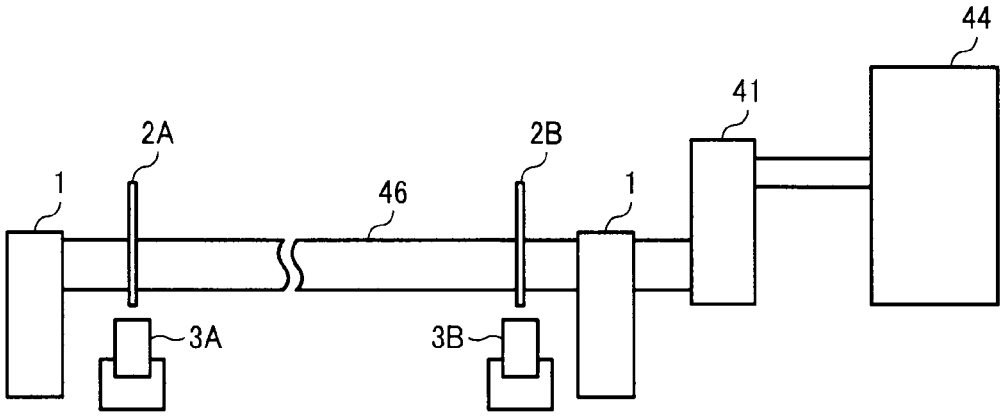
FIG. 3 is a schematic cross-sectional view illustrating the embodiment of the heating fixer in FIG. 2.

FIGS. 2 and 3 are schematic configuration views illustrating an embodiment of the heating fixer of the present invention.

The heating fixer of the present invention includes a fixing roller 6 as a fixing member heating and melting a toner image, a pressure roller 5 as a pressure member contacting the fixing member upon application of pressure to form a nip 10, a variable device varying the pressure of the pressure member (a biasing member) 8 to the fixing roller 6 with rotation of a cam 1 to vary a width of the nip 10 into at least three steps, a drive motor 44 rotating the cam 1 and at least two position detectors detecting a rotational position of the cam 1.

The position detector is formed of fixed transmission sensors 3A and 3B and blocking fillers 2A and 2B coaxially rotating with the cam 1 in a body. The blocking filler 2 has a blocking blade (42 in FIG. 4) blocking light received by the transmission sensor 3. The blocking blade 42 is formed between the plural blocking fillers 2A and 2B so as to have phases different from each other.

When the blocking filler 2 rotates, the blocking blade cuts across the light received by the transmission sensor 3 to switch on and off of signals produced by thereby, and the rotational position of the cam 1 is controlled by the number of switching on and off thereof.

The fixing roller 6 and the pressure roller 5 each includes a halogen heater 40 as a heater.

A transfer paper bearing a toner is heated and pressed at the nip 10 formed of the fixing roller 6 and the pressure roller 5 such that the toner is fixed on the transfer paper.

The pressure roller 5 is pressed to the fixing member by a pressurizer 8 with a pressure variable by the rotatable cam 1. The cam 1 is fixed on a rotational shaft 46 and located before or after the pressure roller 5. At least one (two in the embodiment in FIGS. 2 and 3) of the blocking filler 2 is fixed on the rotational shaft 46 as a position detector of the cam 1. The blocking filler 2 has plural nearly rectangular (or fan-like) blocking blades as members blocking light received by the transmission sensor.

Figure 4:
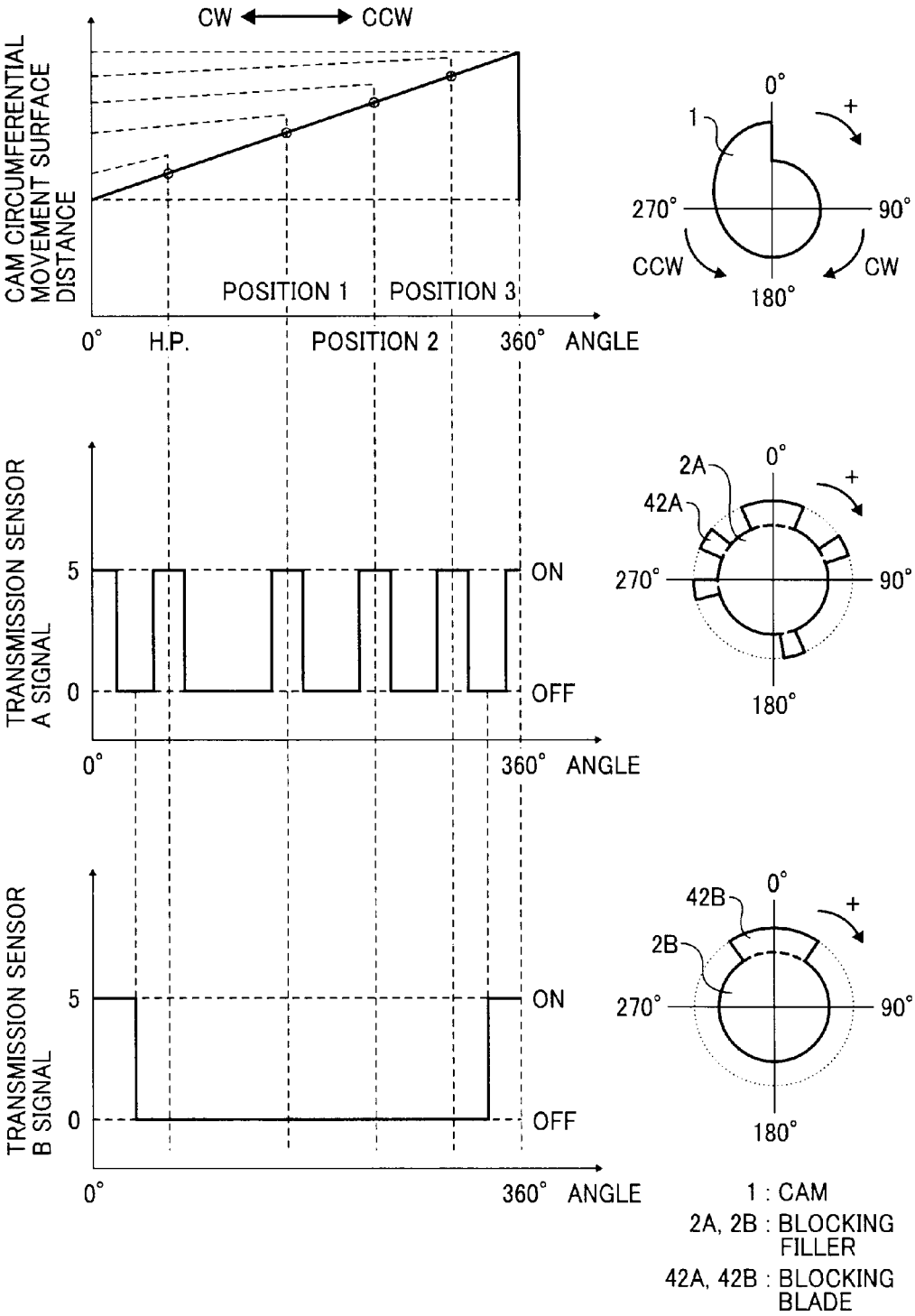
FIG. 4 is a diagram showing a relationship between a distance from a shaft center to a circumferential movement surface of a cam and two blocking filler in the heating fixer of the present invention.

FIG. 4 is a diagram showing a relationship between a distance from a shaft center to a circumferential movement surface of a cam and two blocking filler in the heating fixer of the present invention. In this embodiment, the cam 1 is designed to have a shape having a H.P. and three positions (positions 1 to 3) as three-step nip width. One of the two blocking fillers 2A has plural blocking blades and the other blocking filler 2B has one blocking blade. The number of the rectangular blocking blades needs to be at least larger than that of the positions of the nip width, and in this embodiment, the blocking fillers 2A has five blocking blade 42A. CW and CWW represent rotational directions.

In the plural position detectors, when the plural blocking fillers having blocking blades 42 having different numbers and locations, respectively rotate with the cam 1, the respective blades have phases different from each other.

The cam 1 is determined to be malfunctioned when the transmission sensors 3A and 3B are both on, and failures due to erroneous detections and breakdowns of the sensors can be detected.

Figure 5:
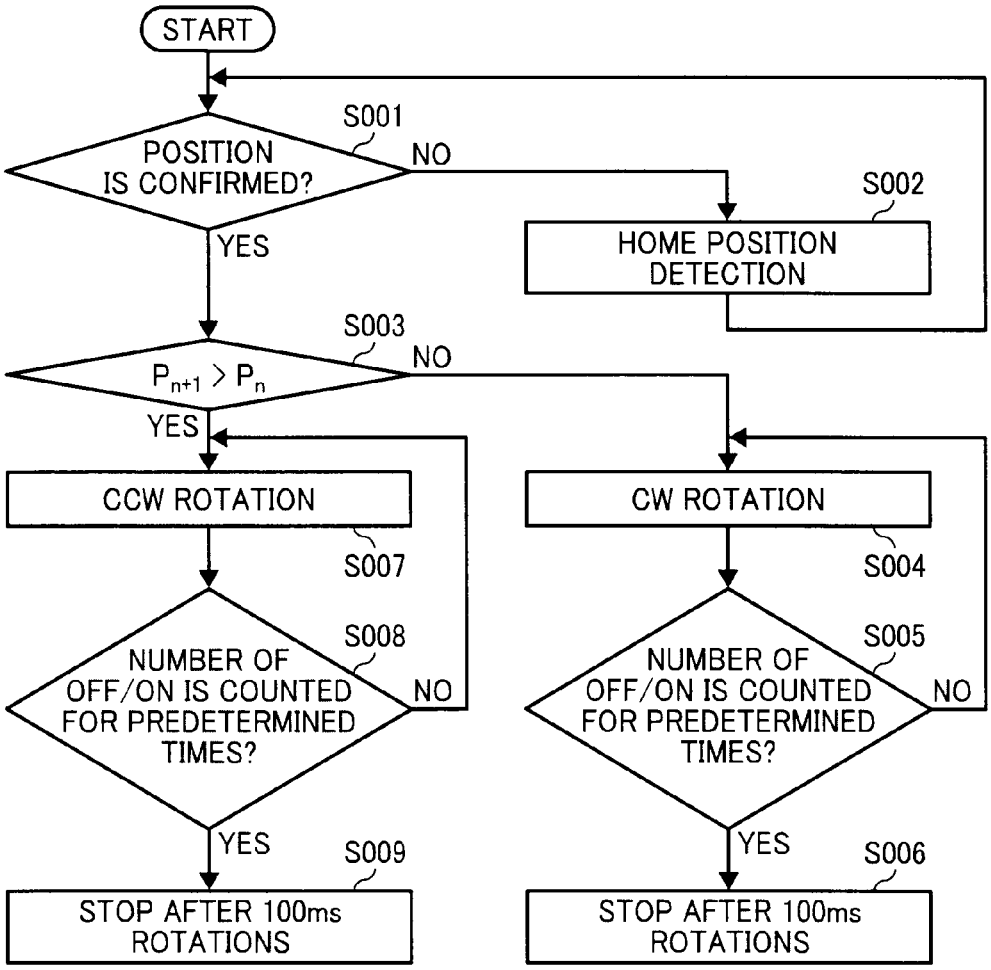
FIG. 5 is a flow chart for explaining a flow of detecting a rotational position of the cam in the present invention.
Figure 6:
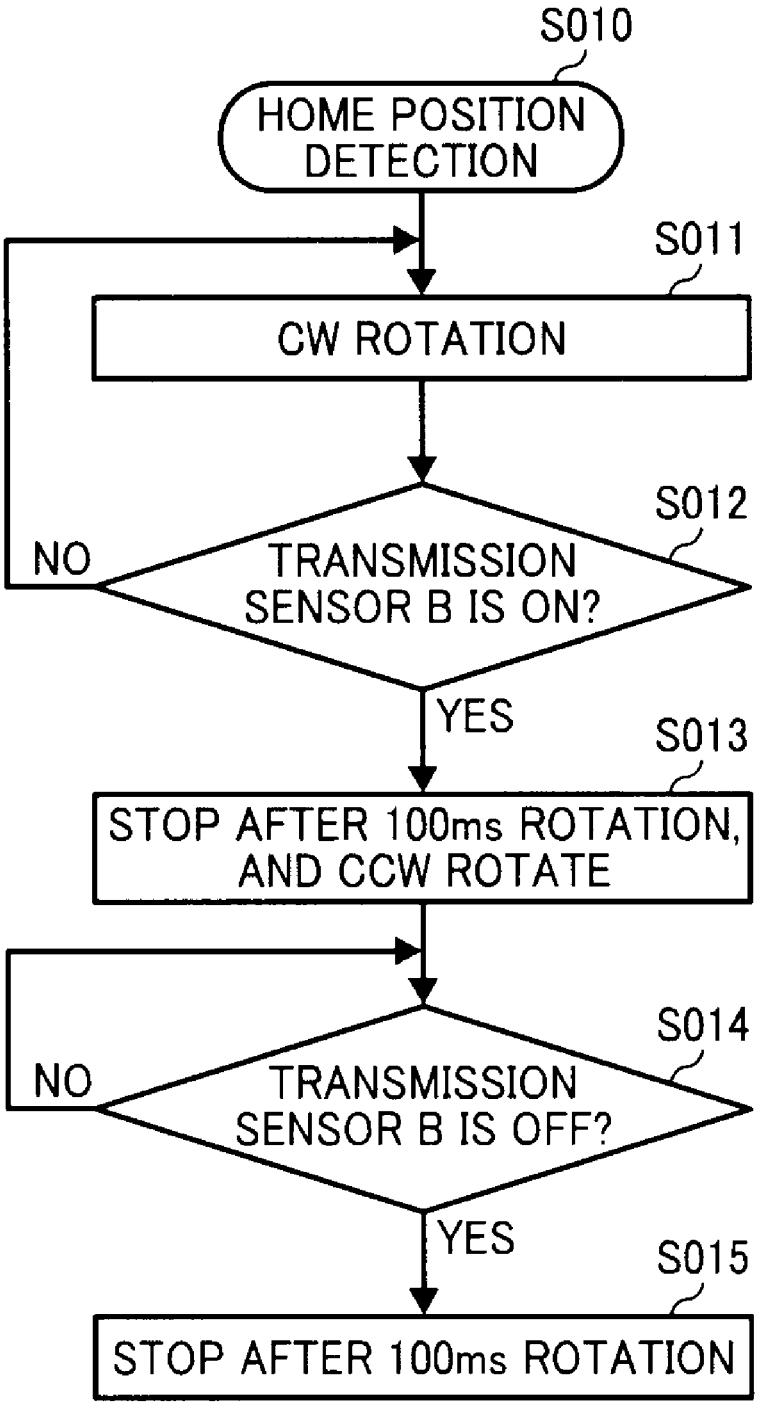
FIG. 6 is a flowchart for explaining a flow of detecting a home position of the cam in the present invention.

FIGS. 5 and 6 are flow charts for explaining flows of detecting rotational positions of the cam.

Information needed to detect rotational positions of the cam 1 includes the number of switching on and off of the transmission sensors 3A and 3B, particularly, the number of changing from off to on of signals (hereinafter referred to as "OFF/ON number"), and a rotational direction of a drive motor 4. Information to be stored includes positional information of the cam 1 and OFF/ON number.

As FIG. 5 shows, checking a positional information of the cam 1 (S001), detecting the H.P. when it is not sure (S002). FIG. 6 is a flow chart of detecting a home position of the cam. The drive motor rotates in CW direction when Pn is larger than $P_{n+1}$, wherein Pn is a current position of the cam 1 and $P_{n+1}$ is a next position thereof (S004).

Next, whether a predetermined number of OFF/ON numbers (S005) are counted is checked, and the drive motor is rotated for 100 ms and stopped (S006) after the predetermined number of OFF/ON numbers are counted. The drive motor rotates in CCW direction when Pn is smaller than $P_{n+1}$ (S007). Then, whether a predetermined number of OFF/ON numbers (S008) are counted is checked, and the drive motor is rotated for 100 ms and stopped (S009) after the predetermined number of OFF/ON numbers are counted.

As FIG. 6 shows, the drive motor is rotated in CW direction to detect H.P. (S011), and whether a signal of the transmission sensor 3 is ON is checked (S012). When ON is detected, the drive motor is rotated for 100 ms and stopped, and rotated in CCW direction (S013). Next, whether a signal of the transmission sensor 3 is OFF is checked (S014), and when OFF is detected, the drive motor is rotated for 100 ms and stopped, and the positional information is stored as a H.P. of the cam 1.

Figures 7, 8:
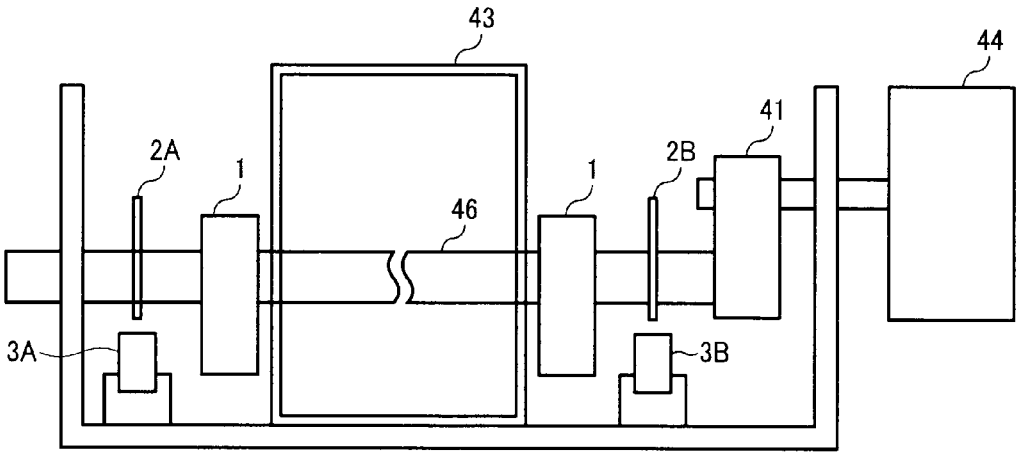
FIG. 7 is a table showing the number of switching on and off of signals of the transmission sensor needed to transferring the cam from a present position to a predetermined position.
FIG. 8 is a schematic cross-sectional view illustrating another embodiment of the heating fixer of the present invention.

FIG. 7 is a table showing the number of switching on and off of signals of the transmission sensor needed to transferring the cam from a present position to a predetermined position.

In this embodiment, the number of nearly-rectangular blocking blades of the blocking filler is the same of the nip width positions, but does not need to be the same, and Off/ON number may properly be set. Timing of stopping rotation is same. Thus, change into most suitable nip width according to papers and their thickness can be made in a short time. In addition, required positions are detected in every transfer and failures due to shifts from desired positions can be prevented.

The drive motor is preferably a stepping motor.

The stepping motor can prevent a shift of stop position due to inertia when stopped to precisely stop the cam 1 at a desired position.

As FIG. 8 shows, when the transmission sensors 3A and 3B are fixed at places facing the blocking fillers 2A and 2B, respectively. When the fixing roller 6 and the pressure roller 5 are included in a detachable heat fixing unit 43, the transmission sensor 3 is preferably located at the outer side of the heat fixing unit 43. This saves cost because the transmission sensor does not need to be exchanged together with the heat fixing unit when exchanged.

Figure 9:
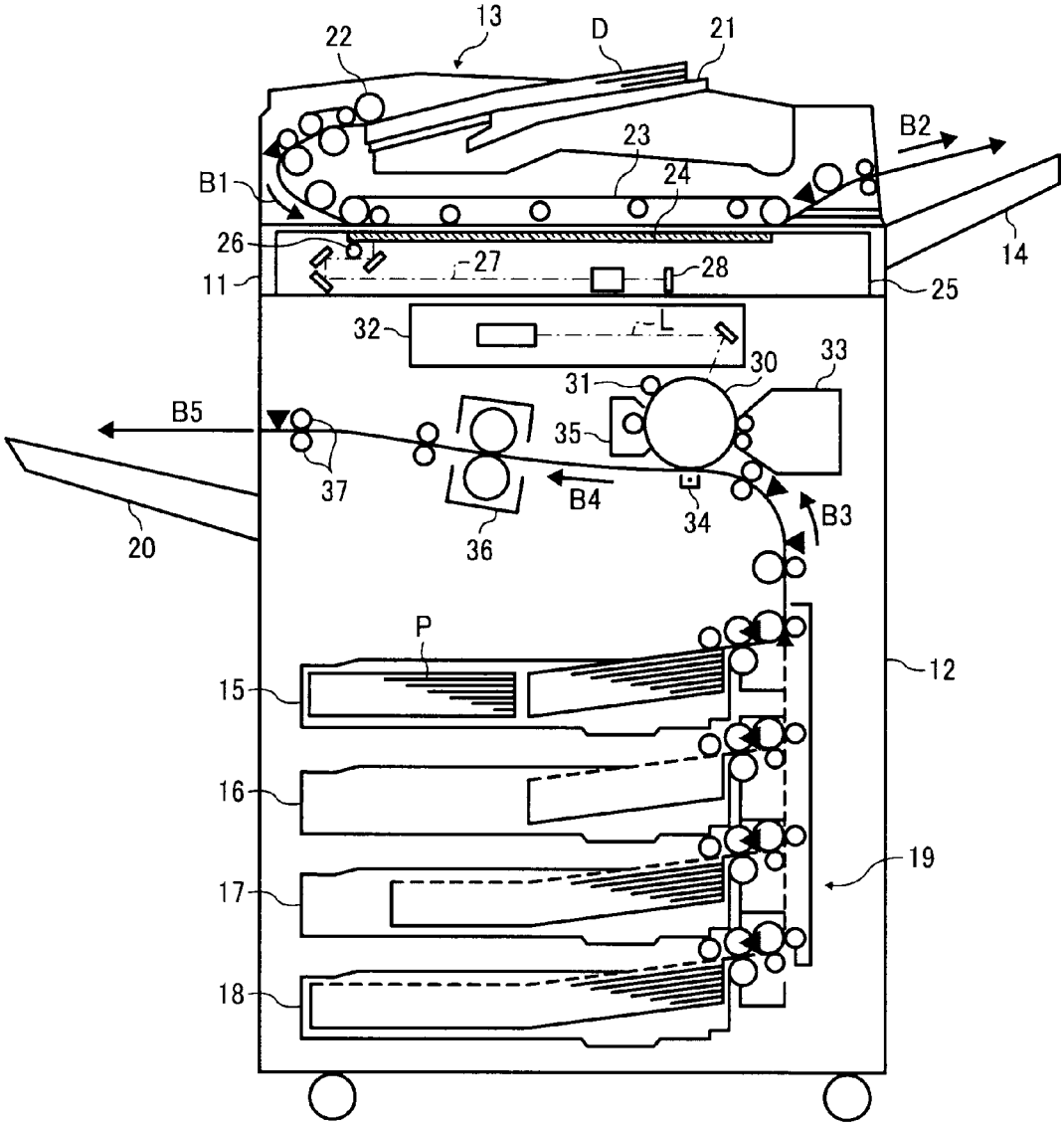
FIG. 9 is a schematic cross-sectional view illustrating an embodiment of the image forming apparatus of the present invention.

FIG. 9 is a schematic cross-sectional view illustrating an embodiment of the image forming apparatus including the heating fixer of the present invention.

The image forming apparatus including the heating fixer of the present invention is capable of constantly stopping the cam at a desired position, and quickly and precisely optimizing a nip width according to papers and their thickness.

The image forming apparatus mainly includes the heating fixer 36 of the present invention in an image forming unit 12, a reading unit 11 reading originals, an automatic document feeder (ADF) 13, an original discharge tray 14 stacking originals fed from the ADF 13, a paper feeder 10 including paper feed cassettes 15 to 18, and a discharged paper tray 20 stacking recorded papers.

An original D is set on an original table 21 of the ADF 13, an operation by an unillustrated operation unit such as pushing a print key is made, the uppermost original D is fed in the direction of an arrow B1 by the rotation of a pickup roller 22, fed onto a contact glass 24 fixed on the reading unit 11 by the rotation of an original feed belt 23, and stopped.

An image of the original D placed on the contact glass 24 is ready by a reader 25 located between the image forming unit 12 and the contact glass 24.

The reader 25 includes a light source 26 illuminating the original D on the contact glass 24, an optical system 27 imaging the original image, and a photoelectric conversion element 28 such as CCD imaging the original image. After finishing reading the image, the original D is fed in the direction of an arrow B2 by the rotation of the feed belt 23 and discharged onto the discharge tray 14. Thus, the originals D are fed onto the contact glass 24 one by one and the original reading unit 11 reads the original images.

The image forming unit 12 includes a photoreceptor 30 as an image bearer. The photoreceptor 30 rotates clockwise and the surface thereof is charged by a charger 31 to have a predetermined potential. A writing unit 32 irradiate an optically-modulated laser beam L according to image information read by the reader 25 to the surface of the photoreceptor 30 to form an electrostatic latent image thereon. The electrostatic latent image is developed by an image developer 33 to form a toner image on the photoreceptor 30, and the toner image transferred by a transferer 34 onto a recoding medium P fed between the photoreceptor 30 and the transferer 34. The surface of the photoreceptor 30 is cleaned by a cleaner 35 after the toner image is transferred.

Recording media P such as papers are contained in the plural paper feed cassettes 15 to 18 located at the bottom of the image forming unit 12. A recording medium P is fed from one of the paper feed cassettes 15 to 18 in the direction of an arrow B3, and a toner image formed on the photoreceptor 30 is transferred on the surface of the recording medium P. Next, as an arrow B4 shows, the recording medium P pass the heating fixer 36 of the present invention in the image forming unit 12, and the toner image transferred onto the surface of the recording medium P is fixed thereon upon application of heat and pressure. The recording medium P having passed the heating fixer 36 of the present invention is transported by a pair of discharge rollers 37 and discharged onto the discharged paper tray 20, and stacked.

Figure 10:
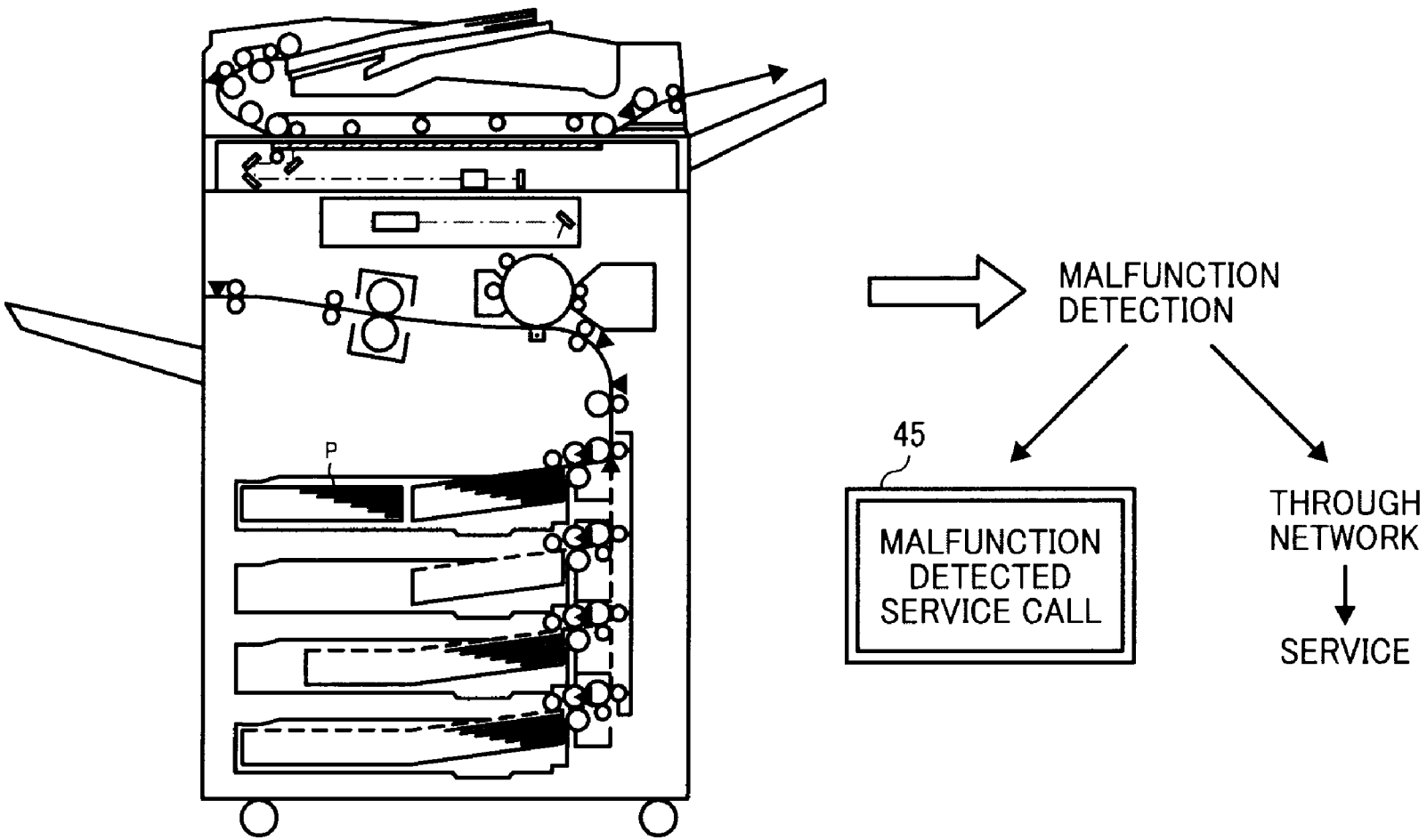
FIG. 10 is an explanatory view illustrating a method of displaying malfunction detection of the image forming apparatus of the present invention.

FIG. 10 is an explanatory view illustrating a method of displaying malfunction detection of the image forming apparatus of the present invention.

The image forming apparatus of the present invention includes a display 45, and which displays malfunction of the image forming apparatus when detected with a signal produced by the transmission sensor 3. Specifically, information of detected malfunction is displayed through a controller on a panel visible to an operator.

The image forming apparatus connected with a network displays the malfunction on the display 45 and automatically notifies servicemen of the malfunction as well. This can shorten a downtime.

This application claims priority and contains subject matter related to Japanese Patent Application No. 2009-205034, filed on Sep. 4, 2009, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A heating fixer, comprising:

a fixing member configured to heat and melt a toner image;

a pressure member configured to contact the fixing member upon application of pressure to form a nip;

a pressure member controller comprising a cam, configured to vary the pressure of the pressure member against the fixing member with rotation of the cam to set the nip to at least three different widths;

a drive motor configured to drive the cam; and at least two position detectors configured to detect a rotational position of the cam, each of the position detectors including a corresponding fixed transmission sensor and a corresponding blocking filler coaxially rotating with the cam in a body, the blocking fillers of the position detectors comprising a corresponding blocking blade capable of blocking light received by the transmission sensor, the blocking blades of the blocking fillers having phases different from one another, the blocking blades cutting across the light received by the transmission sensor to switch on and off signals of the transmission sensor as the blocking filler rotates, and the rotational position of the cam controlled by switching the signals of the transmission sensor.

2. The heating fixer of claim 1, wherein at least one of the position detectors detects a home position of the cam and the other detectors detect the number of times the signals of the transmission sensor are switching on and off.

3. The heating fixer of claim 1, wherein the drive motor is a stepping motor.

4. The heating fixer of claim 1, wherein the position detector is capable of detecting malrotation of the cam.

5. The heating fixer of claim 1, wherein the fixing member and the pressure member form a detachable heat fixing unit and the transmission sensor is located on the outer side of the heat fixing unit.

6. An image forming apparatus, comprising:

a photoreceptor configured to bear an image;

a charger configured to charge the surface of the photoreceptor;

an irradiator configured to irradiate the surface of the photoreceptor with imagewise light to form an electrostatic latent image thereon;

an image developer configured to develop the electrostatic latent image with toner to form a toner image;

a transferer configured to transfer the toner image onto a recording medium;

the heating fixer according to claim 1, configured to fix the toner image on the recording medium; and a cleaner configured to clean the surface of the photoreceptor after the toner image is transferred.

7. The image forming apparatus of claim 6, further comprising a display which displays a malfunction which is detected in response to a signal produced by the transmission sensor.

* * * * *